US005085376A

United States Patent [19]

Litchenburg

[11] Patent Number: 5,085,376

[45] Date of Patent: Feb. 4, 1992

[54] COMMERCIAL-GRADE GRINDING AND MULCHING MACHINE

[75] Inventor: John L. Litchenburg, Chanute, Kans.

[73] Assignee: Tolle Mfg. Co., Inc., Denver, Colo.

[21] Appl. No.: 695,939

[22] Filed: May 6, 1991

[51] Int. Cl.[5] ..... B02C 13/10

[52] U.S. Cl. ..... 241/56; 241/74

[58] Field of Search ..... 241/56, 37.5, 152 A, 241/74, 36

[56] References Cited

U.S. PATENT DOCUMENTS

| | | | |
|---|---|---|---|
| 1,621,571 | 3/1927 | Witz | 241/56 |
| 1,778,564 | 10/1930 | Pettibone | 241/56 |
| 2,361,278 | 10/1944 | Evans . | |
| 2,376,361 | 5/1945 | Johnston | 241/56 |
| 3,014,515 | 12/1961 | Meeker et al. | 241/37.5 |
| 3,157,366 | 11/1964 | Rogers | 241/56 |
| 3,276,700 | 10/1966 | Eklund . | |
| 3,756,517 | 9/1973 | Hock et al. | 241/56 |
| 3,917,176 | 11/1975 | Carlsmith | 241/55 |
| 4,632,319 | 12/1986 | Schlund et al. | 241/37.5 |
| 4,651,934 | 3/1987 | Bender et al. | 241/36 |
| 4,951,882 | 8/1990 | Ober | 241/55 |

*Primary Examiner*—Frank T. Yost
*Assistant Examiner*—John M. Husar
*Attorney, Agent, or Firm*—Litman, McMahon & Brown

[57] ABSTRACT

An apparatus for grinding and mulching landscape debris includes a plurality of cylindrical chambers of different sizes. A first intake chamber has an opening through which the landscape debris is inducted into the apparatus. A second, larger diameter cutting chamber is connected to and is concentric with the intake chamber. A plurality of cutting blades chop the landscape debris which is present in the cutting chamber. A third, still larger hammer chamber is connected to and is concentric with said cutting chamber. The hammer chamber includes a plurality of free-swinging hammers which grind the landscape debris to a size which can exit through a perforated grinding ring which surrounds the hammer chamber. A blower chamber surrounds the perforated grinding ring, the blower chamber including a plurality of rotating fan blades which force air out of an exit opening in the blower chamber, thus creating a partial vacuum in the hammer chamber. The increasing sizes of the intake, cutting, and hammer chambers assure that the average dwell time of debris particles per unit length of chamber decreases as the debris particles proceed from the intake chamber to the cutting chamber and then to the hammer chamber.

2 Claims, 2 Drawing Sheets

COMMERCIAL-GRADE GRINDING AND MULCHING MACHINE

BACKGROUND OF THE INVENTION

The present invention relates to a commercial-grade grinding and mulching machine which is capable of reducing landscape debris such as leaves, grass clippings, brush and small branches to a volume which is usable in developing compost or mulch.

In recent years, the disposal of landscape debris such as leaves, grass clippings, brush and branches has presented major problems. The traditional method of raking such landscape debris into piles and burning it has been curtailed by environmental and clean air concerns. Many communities have severely limited or even totally banned open air burning. Alternatively, such landscape debris has been bagged and transported to neighborhood landfills, but the landfill capacity is constantly shrinking and, in some areas, disposal costs have increased ten-fold.

Landscape debris can also be composted to provide a soil enriching mulch for gardens and landscaping. However, the decomposition of intact leaves, grass clippings, brush and branches is a slow process which can take several years. It is well known that chopping and shredding the landscape debris can substantially reduce its volume and enhance the decomposition process.

A plurality of conventional devices for shredding and composting landscape debris are available. Choppers and shredders of many different sizes and configurations are being marketed by a variety of manufacturers. These choppers and shredders generally include a chute or hopper for introducing the debris to be chopped or shredded into a chamber which includes a plurality of knives and/or hammers which chop and/or pulverize the debris. Often the chamber is surrounded by a mesh screen with holes in the mesh sized to pass the desired particle size of the chipped and pulverized debris. The debris is circulated within the chamber until it is chopped and/or pulverized to a size which will pass through the screen.

Prior art chippers and shredders have a single chamber which is used for cutting and pulverizing the introduced debris. This arrangement requires debris to be introduced directly into the pulverizing chamber at a relatively high velocity. This means that debris being introduced into the chamber impacts with debris which is circulating within the chamber, thus disturbing the efficient circular flow of the material circulating within the chamber and reducing the efficiency of the chipper or shredder. Furthermore, many conventional machines introduce material near the periphery of a circular chamber where the velocity of the recirculating material within the chamber is at its greatest. This increases the interference effect between the debris being introduced and the debris being recirculated.

It is clear then, that a need exists for a landscape debris grinding and mulching machine which can introduce and process large volumes of landscape debris in a rapid and efficient manner.

SUMMARY OF THE INVENTION

The present invention is a commercial grade grinding and mulching machine for efficiently reducing landscape debris to a volume which can be used to develop compost or mulch.

The machine comprises a plurality of concentric cylindrical chambers which are connected to each other in a tiered "wedding cake" fashion. Landscape debris is introduced into a comparatively small intake chamber at a first rate and velocity. The debris then flows into a second, comparatively mid-sized cutting chamber where the flow rate of the debris is reduced and the volume expanded. The debris is cut into smaller particles by a plurality of cutting blades located in the cutting chamber and at the confluence between the cutting chamber and a comparatively larger hammer chamber. The chopped debris then flows into the larger hammer chamber where it is ground and pulverized by a plurality of circulating hammers. A perforated grinding ring surrounds the hammer chamber, with the perforations sized to permit the egress of a desired size of particle. The grinding ring is surrounded by a blower chamber which is a donut-shaped outer chamber including a plurality of spinning blower blades which act to force the pulverized debris into and through an ejection chute.

The concentric arrangement and the graduating sizes of the intake, cutting, and hammer chambers act to introduce large volumes of landscape debris at low velocities into the machine. This increases the dwell time of individual particles of debris within the cutting and hammer chambers and minimizes the effects of debris being introduced interfering with debris already circulating within the chambers.

The machine is preferably driven by an ordinary gasoline engine or other suitable motor which can be mounted with the machine on a small towable trailer. Landscape debris can be introduced into the intake chamber by hand through a feed chute or a vacuum hose and scoop can be attached so that the entire apparatus can be used as a lawn vacuum. The ejection chute is preferably fixed, but an accessory hose can be attached which allows the processed material to be directed to any desired position by an operator.

OBJECTS AND ADVANTAGES OF THE INVENTION

The principal objects of the present invention are: to provide an improved grinding and mulching machine for landscape debris; to provide such a machine which efficiently introduces and processes such landscape debris; to provide such a machine which has a plurality of concentric cylindrical chambers sized and arranged to step down the flow rate of debris introduced into the machine; to provide such a machine which minimizes the interference between debris being introduced and debris already circulating within the machine; to provide such a machine which is easily transportable; to provide such a machine into which landscape debris can be introduced via a vacuum tube or a manual feed chute; to provide such a machine which has a perforated grinding ring surrounding a hammer chamber, with the perforations sized to permit the egress of particles of a desired diameter; to provide such an apparatus which has a blower chamber surrounding the grinding ring, the blower chamber developing a vacuum-effect which functions to propel processed debris through the grinding ring into the blower chamber and out through an ejection chute; and to provide such a machine which is particularly well adapted for its intended purpose.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figures 1, 2, 6:
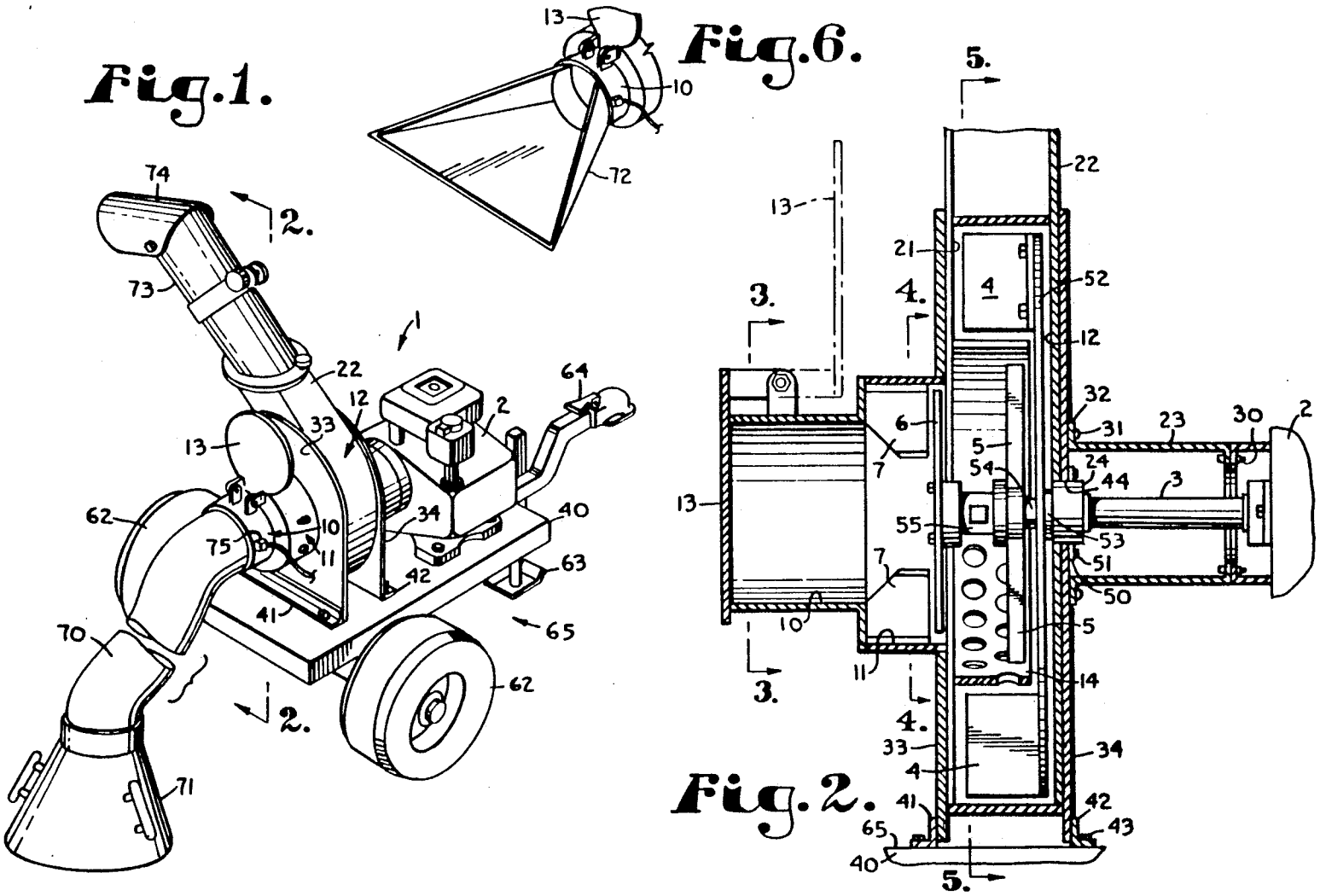
FIG. 1 is a perspective view of a grinding and mulching machine in accordance with the present invention, shown mounted on a trailer.
FIG. 2 is an enlarged and fragmentary cross-sectional view of the grinding and mulching machine, taken along line 2—2 of FIG. 1.
FIG. 6 is a perspective view of an optional hopper for attachment to the grinding and mulching machine.

Referring to FIG. 1, the reference numeral 1 generally indicates a grinding and mulching machine in accordance with the present invention. The machine 1 includes motor means such as is illustrated by a gasoline engine 2 to drive a rotary drive shaft 3 (FIG. 2). The drive shaft 3 drives a plurality of fan blades 4, a plurality of hammers 5, and a plurality of cutting knives 6, as shown in FIG. 2. Referring again to FIG. 1, the grinding and mulching machine 1 also comprises a plurality of concentric cylindrical chambers 10, 11 and 12, of sequentially increasing diameters.

The first chamber 10 is an intake chamber and has an opening 15 (FIG. 3) at one end which is covered by a hinged cover plate 13. Landscape debris to be mulched and ground is introduced through the opening 15 and into the intake chamber 10. Referring again to FIG. 2, the landscape debris then flows from the intake chamber 10 into the second chamber 11 that is a larger cutting chamber where it encounters a plurality of fixed knives 7 and the rotating cutting knives 6. The landscape debris is chopped by the fixed knives 7 and the cutting knives 6, and the resulting chopped debris enters the third chamber 12 that is a still larger hammer and blower chamber.

The hammer and blower chamber 12 has a stationary, circular perforated grinding ring 14 mounted therein which divides the chamber 12 into a hammer chamber section 19 and a blower chamber section 21. The plurality of hammers 5 rotate with the hammer chamber section 19 inside the grinding ring 14 and act to grind the chopped-up landscape debris into smaller and smaller particles until the particles are small enough to fit through perforations 20 in the grinding ring 14.

The area within the blower chamber section 21 operably functions as a blower which propels the ground and mulched landscape debris out of an exit chute 22. A plurality of fan blades 4 rotate within the blower chamber section 21, acting to create a partial vacuum which draws processed debris particles through the perforations 20 and forces them out of the exit chute 22. It should be noted that the grinding ring 14 has t he perforations 20 only on the bottom half. Thus, processed debris particles can only exit through the bottom of the grinding ring 14. This prevents exiting processed particles from interfering with the outward flow of particles through the exit chute 22.

As further illustrated in FIG. 2, the drive shaft 3 is connected to the motor 2 through a drive shaft housing 23 which is attached to the motor 2 by a plurality of nuts and bolts 30 at one end and is attached to the grinding and mulching machine 1 by a further plurality of bolts 31 through flanges 32.

A pair of semi-circular steel support plates 33 and 34 support the grinding and mulching machine 1 and anchor it to a platform 40 via a pair of attached angle irons 41 and 42 and a plurality of nuts and bolts 43. The semi-circular support plate 34 has a centrally located aperture 44 which is positioned and sized to accommodate the drive shaft 3 and a single bearing race 24 which supports the drive shaft 3. The bearing race 24 is attached to the semi-circular support plate 34 via a plurality of flanges 50 and throughbolts 51.

The plurality of fan blades 4 are bolted to a rotating blower disc 52. The rotating blower disc 52 is directly attached to the drive shaft 3 via suitable attachment means such as set screws or the like.

Figure 5:
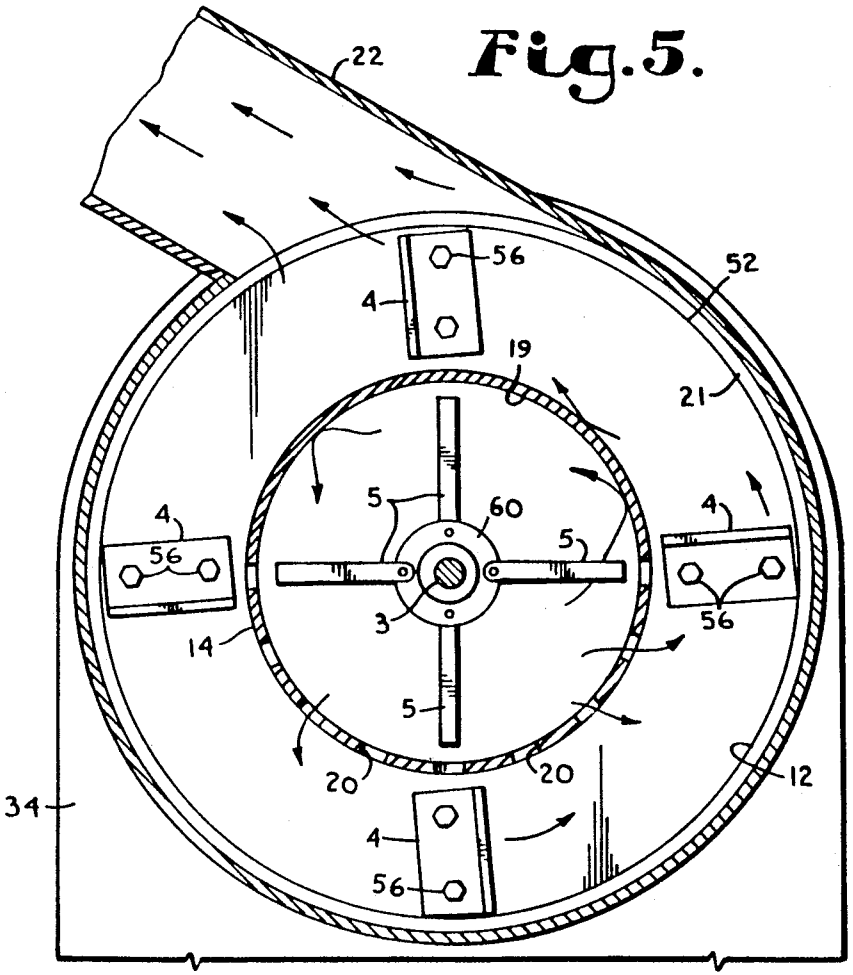
FIG. 5 is an enlarged and fragmentary cross-section view of the grinding and mulching machine, taken along line 5—5 of FIG. 2, illustrating a hammer chamber thereof and showing the direction of flow of debris being processed in the hammer chamber and exiting through a blower.
Figure 4:
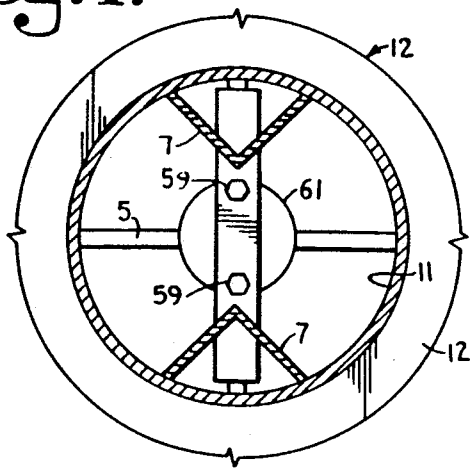
FIG. 4 is an enlarged and fragmentary cross-sectional view of the grinding and mulching machine, taken along line 4—4 of FIG. 2, illustrating a cutting chamber thereof.

A series of spacers 53, 54, and 55 surrounds the drive shaft 3. The spacer 53 acts to space the rotating blower disc 52 away from the sidewall of the hammer and blower chamber 12. The spacer 54 is connected at one end to the other side of the rotating blower disc 52 and at the other end to a hammer support disc 60, as is best illustrated in FIG. 5. The plurality of hammers 5 are loosely attached to the support disc 60. The spacer 55 is attached at one end to the hammer support disc 60 and at the other end to a rotating blade support disc 61. The rotating blades 6 are bolted to the rotating blade support disc 61, as is best illustrated in FIG. 4. A plurality of stationary angled knives 7 are located within the cutting chamber 11.

FIG. 1 illustrates the grinding and mulching machine 1 mounted on a trailer 65 of which the platform 40 forms a part. The trailer 65 includes a pair of ground-engaging wheels 62, a support jack 63, and a tongue and trailer hitch 64. The trailer 65 is suitable for towing behind a lawn tractor, pickup truck, or the like. FIG. 1 illustrates an optional vacuum hose 70 and vacuum scoop 71 which are suitable for vacuuming leaves, grass clippings or the like. Alternatively, a hopper 72, as illustrated in FIG. 6, can be attached to the grinding and mulching machine 1 by raising the cover plate 13 and connecting to the opening of the chamber 10 to accommodate larger, hand-fed material. FIG. 1 also shows an exit chute extension 73 attached to the exit chute 22. The extension 73 includes a hinged safety cover plate 74 for directing exiting material to a desired location. It is foreseen that a larger exit chute extension or a flexible hose can be attached so that exiting material can be directed to a desired location such as plastic bags, pickup beds, or compost piles.

FIG. 2 illustrates the hinged cover plate 13 in solid lines covering the end of the intake chamber 10 and in phantom lines rotated 180 degrees to uncover the end of the extension plate 10. A safety switch 75 is attached to the outside periphery of the intake chamber 10, as illustrated in FIG. 1. The safety switch 75 acts to ground a sparkplug lead of the gasoline-powered engine 2 unless the hinged cover plate 13 or a suitable attachment such as the vacuum hose 70 or the feed hopper 72 are attached to the intake chamber 10.

Figure 3:
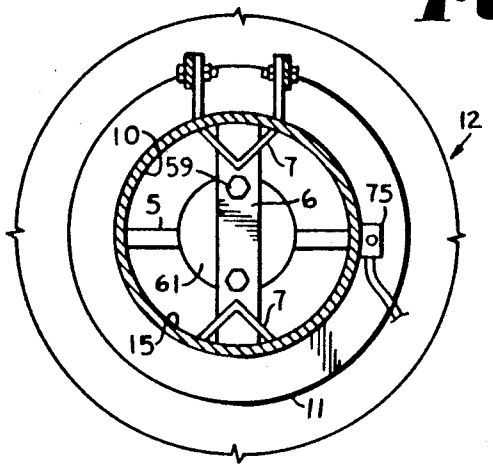
FIG. 3 is an enlarged and fragmentary cross-sectional view of the grinding and mulching machine, taken along line 3—3 of FIG. 2, illustrating an intake chamber thereof.

FIGS. 3, 4 and 5 are a series of cross-sectional views of the grinding and mulching machine 1, taken along lines 3—3, 4—4, and 5—5, respectively, of FIG. 2.

FIG. 3 is a view illustrating the relative sizes of the intake chamber 10, the cutting chamber 11, and the hammer and blower chamber 12. FIG. 3 also illustrates the placement of the safety switch 75 and hinge supports 80 and 81 for the hinged cover plate 13.

FIG. 4 is a view of the cutting chamber 11, illustrating the relative placement of the fixed knives 7 and the rotating cutting knives 6. Each of the cutting knives 6 comprise a single flat blade which is attached to the rotating blade support disc 61 by a plurality of attachment bolts 59.

FIG. 5 is a view of the hammer and blower chamber 12. The chamber 12 is divided by the perforated grinding ring 14 onto the outer blower chamber section 21 and the inner hammer chamber section 19. The hammers 5 are loosely attached onto the hammer support disc 60 so that they are free-swinging. By attaching the hammers 5 to be free-swinging, the hammers 5 will swing back and forth over irreducible debris such as rocks, etc. and will not jam the machine 1. The plurality of fan blades 4 are each attached to the blower disc 52 by a plurality of threaded bolts 56. As the blower disc 52 rotates with the drive shaft 3 the fan blades 4 exhaust air from inside the blower chamber section 21 through the exit chute 22. This acts to create a partial vacuum within the hammer chamber section 19.

The operation of the grinding and mulching machine 1 will now be described with particular reference to FIGS. 2 and 5. A quantity of landscape debris, such as leaves, grass clippings and small sticks are introduced into the intake chamber 10 via the vacuum hose 70 or, alternatively, the feed hopper 72. The quantity of landscape debris along with air enters the intake chamber 10 at a volume having a first diameter associated therewith and at a first flow rate. For purposes of a simplified analysis, it is assumed that the fluid flow is one-dimensional, i.e. flowing from left to right, through the intake chamber 10. Assuming that the fluid velocity through the intake chamber 10 has an average or means value of $V_1$, then the volume of fluid crossing an infinitesimal area A per unit time, called the flux, is VdA. The total volume of fluid per unit time or Q passing through the cross-section of the entire intake chamber 10 is the sum of all the individual amounts or $$Q=\int VdA$$

If A represents the total area of the intake chamber 10 normal to the fluid flow, then an average velocity $V_1$ can be calculated as follows:

$$Q=AV_1 \text{ or } V_1=Q/A$$

As the fluid flow passes from the intake chamber 10 into the larger cutting chamber 11, the equation of continuity for steady flow states that the mass of fluid passing any section per unit time is constant. Assuming that the fluid flowing through the grinding and mulching machine 1 as incompressible, then it can be stated that $$Q=A_1V_2=A_2V_2=\text{Constant}$$

where $A_1$ is the total cross-sectional area of the intake chamber 10 and $V_1$ is the mean fluid flow rate through the intake chamber 10, $A_2$ is the total cross-sectional area of the cutting chamber 11 and $V_2$ is the mean fluid flow rate through the cutting chamber 11.

It can readily be seen that, as the cross-sectional area increases from intake chamber 10 to cutting chamber 11, the flow rate of the fluid decreases proportionately. Thus, on average, any landscape debris particle spends more time in the cutting chamber 11 than it would if the intake chamber 10 and the cutting chamber 11 were of the same diameter. This means that the debris is more thoroughly processed by the stationary and rotary knives within the cutting chamber 11 since the average time any particle remains in the chamber 11, which is referred to as dwell time herein, is increased. Since the hammer chamber 19 is again larger in diameter than the cutter chamber 11, the same analysis can be made for debris transitioning between the cutting chamber 11 and the hammer chamber section 19.

As the landscape debris passes through the cutting chamber 11, it is repeatedly chopped up by the stationary knives 7 and the rotary cutting knives 6 so that, again on average, the particle sizes which enter the hammer chamber section 19 are considerably smaller than those which enter the intake chamber 10. Once these reduced size particles are in the hammer chamber section 19, the flailing hammers 5 pulverize the debris by grinding it against the perforated grinding ring 14. Again, the spinning fan blades 4 within the blower chamber section 21 act to create a partial vacuum within the hammer chamber section 19. The partial vacuum acts to draw debris particles which have been pulverized to a sufficient degree through the perforations 20 within the perforated grinding ring 14. Since all the perforations 20 are in the bottom half of the perforated grinding ring 14, the pulverized landscape debris enters the bottom half of the blower chamber section 21. This minimizes undesirable interference and eddy currents near the intake of the exit chute 22. The arrows within the hammer chamber section 19 and the blower chamber section 21 in FIG. 5 illustrate the direction of flow of debris particles within these regions.

It has been found that the graduating diameters of the intake chamber 10, the cutting chamber 11, and the hammer chamber section 19 substantially increase the processing efficiency of the grinding and mulching machine 1. The cross-sectional area across the ring or donut shape of the blower chamber section 21 is preferably smaller than that of the intake chamber 10 and more preferably approximately one-third that of the intake chamber 10, thus propelling the pulverized debris out at a velocity of approximately three times the intake velocity of the original material. This increased velocity facilitates the distribution of the processed debris to desired locations. By attaching an optional eight-inch accessory hose (not separately illustrated), to the exit chute 22, the processed debris can be directed to virtually any spot the operator chooses.

It is to be understood that while certain forms of the present invention have been illustrated and described herein, it is not to be limited to the specific forms or arrangement of parts described and shown.

What is claimed and desired to be secured by Letters Patent is as follows:

1. An apparatus for reducing landscape debris including leaves, grass clippings, brush and small branches to mulch, the apparatus comprising:

(a) a cylindrical intake chamber having an opening thereinto for receiving said landscape debris and having a first cross-sectional area;

(b) a cylindrical cutting chamber connected to said intake chamber and having a second cross-sectional area that is greater than said first cross-sectional area;

(c) said cutting chamber containing a plurality of cooperating fixed and rotating cutting knives;

(d) a cylindrical hammer chamber connected to said cutting chamber and having a third cross-sectional area greater than said second cross-sectional area;

(e) said hammer chamber including a plurality of free-swinging hammers;

(f) a perforated grinding ring surrounding said hammer chamber, said hammers being adapted to grind said debris to a size that will pass through the perforations in said grinding ring;

(g) a donut shaped blower chamber surrounding said perforated grinding ring, means forming an exit opening in said blower chamber;

(h) a plurality of fan blades positioned to rotate through said blower chamber to exhaust air through said exit opening and provide vacuum pressure within said hammer chamber that operably functions to cause air and debris introduced into said intake chamber opening to be drawn through said cutting chamber and said hammer chamber; and (i) means for driving said rotating cutting knives, said hammers and said fan blades.

2. The apparatus as set forth in claim 1 wherein:

(a) said blower chamber exit opening is positioned upwardly of said blower chamber; and (b) said perforated grinding ring is not perforated in the area adjacent said exit opening.

* * * * *